US005188138A

United States Patent [19]

Yamasaki et al.

[11] Patent Number: 5,188,138

[45] Date of Patent: Feb. 23, 1993

[54] WALKING STICK WITH WHEELS

[75] Inventors: Yoshikiyo Yamasaki, Sakai; Shinichiro Fujimoto, Osaka, both of Japan

[73] Assignees: Kabushiki Kaisha Japan Health; Kabushiki Kaisha Fuji Iryoki, both of Osaka, Japan

[21] Appl. No.: 728,175

[22] Filed: Jul. 10, 1991

[51] Int. Cl.[5] ..... A45B 1/00

[52] U.S. Cl. ..... 135/65; 135/74; 135/85; 280/641

[58] Field of Search ..... 135/65, 66, 74, 75, 135/85, 911, 67; 280/641, 87.05; 482/66, 68

[56] References Cited

U.S. PATENT DOCUMENTS

| | | | |
|---|---|---|---|
| 1,136,167 | 4/1915 | Reininger | 135/74 |
| 2,159,301 | 5/1939 | Upton | 135/67 |
| 2,408,604 | 10/1946 | Brickson | 135/74 X |
| 2,656,874 | 10/1953 | Robb | 135/67 |
| 2,683,461 | 7/1954 | Kinney | 135/65 |
| 2,738,830 | 3/1956 | Black | 135/67 |
| 3,158,162 | 11/1964 | Reel | 135/911 X |
| 4,962,781 | 10/1990 | Kanbar | 135/65 |
| 5,020,560 | 6/1991 | Turbeville | 135/67 |

FOREIGN PATENT DOCUMENTS

| | | | |
|---|---|---|---|
| 2742557 | 3/1979 | Fed. Rep. of Germany | 135/67 |
| 1016156 | 11/1952 | France | 135/911 |

*Primary Examiner*—David A. Scherbel
*Assistant Examiner*—Lan Mai
*Attorney, Agent, or Firm*—Flynn, Thiel, Boutell & Tanis

[57] ABSTRACT

This invention is easily assembled walking stick which disposes wheels at the lower end, and it enables user to walk forward in stable state without danger.

This walking stick helps aged persons and sick persons and physically handicapped persons to walk.

And it comprises the main walking stick with a wheel which has the hollow support bar disposed the forward wheel rotatably at the lower end and the assistant walking stick with a wheel which has the hollow assistant bar disposed the back wheel rotatably at the lower end The main walking stick with a wheel and the assistant walking stick with a wheel are tied with the fastening bar member and the hook.

The forward wheel is adjusted by the brake structure.

The hollow support bar can be folded or contracted and expanded.

And it helps user to walk in stable state.

11 Claims, 11 Drawing Sheets

211
21
1
2
23
27
24
3
23
28
39
31
26
32
261
321
22
33

211
1
2
21
23
27
24
3
23
28
39
31
321
26
261
32
22
33

WALKING STICK WITH WHEELS

FIELD OF THE INVENTION

This invention relates to a walking stick for aged persons, sick persons, and physically handicapped persons and so on, who have some difficulty in walking, and more particularly to a walking stick which facilitates use and handling, provides improved safety when it is used, and is more convenient when the person gets on and off of vehicles.

BACKGROUND OF THE INVENTION

Description of prior art;

Aged persons or physically handicapped persons who have artificial legs and so on have some difficulty in walking, and they have anxiety about walking. Therefore they use a walking stick in walking.

A conventional walking stick comprises a walking stick body which is a bar formed in a certain length and is made of wood or metal pipe material, and a handle part, which is ball-like or of reverse U-shape or L-shape, is disposed at the upper part of the body.

In using this conventional walking stick, the user grips the handle part, lifts the walking stick body, and moves it forward, when resting one's weight to one's handicapped foot, then the user advances.

Repeating these movements, the user uses the walking stick as a supporting tool to walk.

However, in using the conventional walking stick, because the user moves it with lifting, it is necessary to lift and lower the walking stick and one's arm. Furthermore the user must put the end of it on the ground, and lean on it, and move one's weight, while balancing oneself all the time and the user walks on.

Consequently the conventional walking stick has the defect that it is burdensome to the muscles of the user's shoulder and arm and causes not only muscular fatigue, i.e., physical fatigue, but also, mental fatigue. For solving the above mentioned defect, a walking stick which has a stability support leg which diverges from the walking stick body at a proper position, two wheels disposed at the lower end of the walking stick body or the lower end of the stability support leg, and one or two wheel(s) disposed at the lower end of the other stick body or support leg has been designed.

In walking, the user pushes it with a little power, the wheels rotate and the walking stick moves. Therefore it can reduce physical fatigue and mental fatigue.

When the user walks, the above mentioned walking stick is convenient compared with the conventional walking stick, because it advances forward easily by rotation of the wheels. However, when it is stopped, it becomes unstable because of the easy rotation of the wheels, and when the user gets on and off vehicles, such as train, bus, taxi and so on, the walking stick is bulky and annoying to other passengers.

In particular, when the walking stick is used on a downward slope, it becomes dangerous. Therefore it can't be used at all.

Furthermore, the walking stick of above mentioned type doesn't have a problem in use on a flat paved road of a sidewalk. However, in use on an unpaved road or a sidewalk, or a road covered with gravel, the wheels run against the obstacles, and they can't advance at all.

It is an object of the invention to provide a walking stick with wheels which is designed in consideration of the above mentioned circumstances, and solves the above mentioned problems.

In normal walking, the user can easily walk and move forward with supporting wheels. In walking on a slope, particularly on a downward slope, the user can walk in a stable state without danger.

Another object of the invention is to provide a walking stick with wheels which do not move easily because of a locking structure, whereby to maintain the user's posture in a safe state when the walking stick is stopped temporarily.

A further object of the present invention is to provide a walking stick with wheels, the width and length of which can be contracted easily to minimize annoyance when the user gets on and off vehicles, such as train, bus, taxi and so on, and it can be kept in an area as narrow as possible when it is not used.

Still a further object of this invention is to provide a walking stick with wheels which can pass over obstacles easily, such as gravel used on an unpaved road or a sidewalk or a road covered with gravel, and can advance smoothly without troubles such as failure to rotate wheels.

An additional object of this invention is to provide a walking stick on which to hang a baggage for the convenience of the user.

SUMMARY OF THE INVENTION

The walking stick with wheels comprises a hollow support bar on the upper end of which is mounted a U-shape or L-shape handle part. A connecting member is rotatably mounted at the center part of the bar between collars which are fixed at the upper and the lower ends of the center part. The main walking stick with a wheel comprises a pair of opposite legs spaced at a certain interval and joined to the lower end of the hollow support bar. A forward wheel has a center rotatably installed between the legs. A hollow bar is disposed through diverging legs on the upper part of the connecting member of the hollow support bar and is located about halfway along the length of the hollow support bar. The assistant walking stick has a wheel disposed between a pair of opposing legs spaced at a certain interval and mounted on the lower end of the hollow assistant bar. The back wheel, wherein the center is rotatably installed between the legs, and the fastening bar member disposed at the center of the assistant walking stick and the hook disposed at the lower end of the connecting bar member to keep in contact with the fastening bar member makes it possible to accomplish above mentioned objects.

The walking stick with wheels has a projection at the back of the center part of the hollow support bar, and an oblong hole is bored so that the projection of the connecting member can prevent the turning angle of the main walking stick with wheels from being in excess of a certain angle. This increases the safety.

Further, in this invention, a thin bar member is disposed with a spring in the handle part of the hollow support bar. An elastic member is disposed at the lower end of the thin bar member to move toward and away from the forward wheel, and to apply the brake when it is needed.

A folding part is provided at the upper part of the hollow support bar. A male screw part is provided at the lower part of the folding part. A small cylindrical stopping member which can engage with the male screw part and can cover the folding part is put on the folding part so that it can be folded.

Further, in this invention, a thin bar member which attached to a spring at the upper end in the handle part and which can fold at the folding part of the hollow support bar is put into the hollow support bar. An elastic member is disposed at the lower end of the thin bar member. When the hollow support bar is extended straight, the elastic member can move the forward wheel and this walking stick can be contracted.

In this invention, when the walking stick is not used, it can be contracted. the hollow support bar is divided into two pieces with the connecting member as the border. The upper part has a U-shape or L-shape handle part mounted thereon. The upper part comprises a short hollow support bar having a projecting ball member attached to the spring at the lower side thereof. A cylindrical fitting member covers the short hollow support bar and it has a plurality of small holes for receiving the projecting ball member in line along the bar whereby to expand and contract the walking stick.

Further, at least one of the forward wheel and the back wheel is formed into a wheel which has a wave-shaped or tooth-shaped rugged part spaced at a certain interval on the periphery to prevent it from stopping on a road that is covered with gravel or an unpaved road.

Further, in this invention, at least one of the wheels which has a wave-shaped or a tooth-shaped rugged part spaced at a certain interval on the periphery also has a round wheel disposed coaxially on the forward wheels whereby to be useful for both a road covered with gravel or an unpaved road and a paved road.

A plurality of stopping small holes are disposed on the sides of the forward wheel. An S-shape locking member has a fitting pin which can fit in the stopping small holes at the end in the space between the forward wheel and the legs and said pin is disposed between the pair of legs for stopping temporarily in safe state when the user walks.

Functions of this Invention;

The walking stick with wheels in constructed as above mentioned. It has functions as follows.

The walking stick with wheels has a main walking stick having a handle part at the upper end and having a forward wheel disposed at the lower end. An assistant walking stick has a back wheel disposed at the lower end. The walking stick can move forward easily, the user pushes it with a little power, the forward wheel and the back wheel rotate easily, it can help the user to walk with as little as possible physical fatigue and mental fatigue.

A projection is disposed at the back of the center part of the hollow support bar. An oblong hole is bored for the projection at a position corresponding the projection of the connecting member to prevent the turning angle of the main walking stick from passing beyond a certain angle. They remove the danger that the main walking stick with wheels will turn suddenly.

The thin bar member attached with a spring at the upper end is put into the handle part of the hollow support bar. The elastic member is disposed at the lower end of the thin bar member. The elastic member can move and stop the forward wheel. When it is needed, the elastic member functions as a brake. The user can walk on slopes, particularly downward slopes in a stable state.

A folding part is provided at the upper part of the hollow support bar. A male screw part is provided at the lower part of the folding part. A small cylindrical stopping member which can engage with the male screw part and can cover the folding part is put on the folding part. Therefore the hollow support bar can be folded, when it is not used. A large storage area is not needed.

At least one of the forward wheel and the back wheel can be formed into a wheel which has a wave-shaped or tooth-shaped rugged part spaced at a certain interval on the periphery. It can get over the obstacles such as gravel. It advances smoothly without troubles of failure to rotate the wheels.

Further, a plurality of stopping small holes are disposed on the sides of the forward wheel. An S-shape locking member is provided with a fitting pin which can fit with the stopping small holes at the end in the space between the forward wheel and the putting boards. The pin is disposed between a pair of legs. Therefore when the user stops temporarily, the wheels don't move easily because of the locking structure. The user can maintain his posture.

The walking stick with wheels in this invention comprises a main walking stick having handle part at the upper end and having a forward wheel at the lower end. The assistant walking stick has a back wheel at the lower end and it can move forward easily.

It is different from the conventional walking stick. It doesn't have the defect that it is burdensome to the muscles of the user's shoulder and arm, it does not cause muscular fatigue or mental fatigue.

The user grips the handle part and pushes with a little power. The forward wheel and the back wheel can rotate easily. It reduces the physical fatigue and mental fatigue of the user to as low a level as possible, and it helps the user to walk.

In this invention, the thin bar member having the spring attached at the upper end is put into the handle part of the hollow support bar. An elastic member is disposed the lower end of the thin bar member. The elastic member can move and stop the forward wheel, when it is needed, the elastic member serving as a brake.

It doesn't have the problem that it increases speed or becomes dangerous in using on a downward slope like a conventional walking stick.

Further, the hollow support bar is constructed to fold and to contract. Therefore it is not bulky and it will not annoy the passengers in getting on and off the vehicles such as train, bus, taxi and so on.

Further, in this invention, at least one of the forward wheel and the back wheel is formed into a wheel which has a wave-shaped or a tooth-shaped rugged part spaced at a certain interval on the periphery.

Consequently, it does not run against obstacles and it can get over them and can advance in using on a unpaved road and a road covered with gravel like as the conventional walking stick.

Further, in this invention, the projection is disposed at the back of the center part of the hollow support bar. An oblong hole is bored for the projection to insert at a position corresponding the projection of the connecting member to prevent the turning angle of the main walking stick with wheels from extending beyond a certain angle. It removes the danger that the main walking stick with wheels will turn suddenly.

The plurality of stopping small holes are disposed on the sides of the forward wheel, an S-shape locking member has a fitting pin at the end in the space between the forward wheel and the legs. Therefore when the user stops temporarily in walking, the wheels don't move easily because of the locking structure. The user can maintain one's posture.

Consequently, this invention removes the defects and solves the problems, and it raises the safety of the user, and makes it easy and safe in operation, and it is most suitable for walking requiring concern for the other people, and it is very effective.

DESCRIPTION OF THE PREFERRED EMBODIMENTS

Embodiment 1

Figure 1:
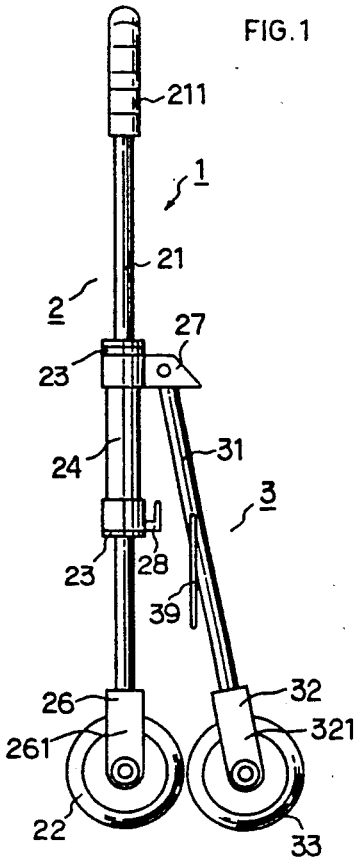
FIG. 1 is a side view of an embodiment of this invention.
Figure 2:
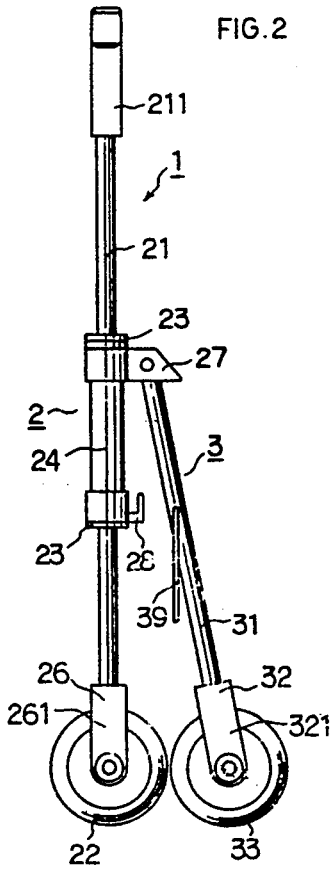
FIG. 2 is a side view of an embodiment of this invention.
Figure 3:
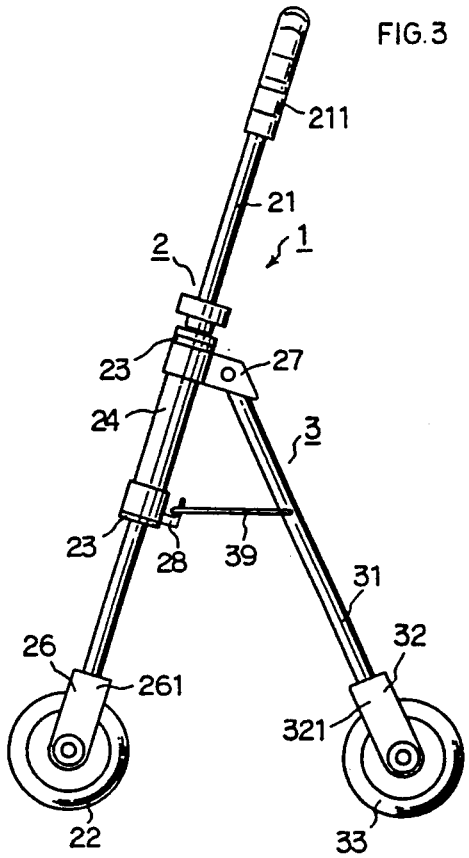
FIG. 3 is a side view of an embodiment of this invention in constructed state.
Figure 4:
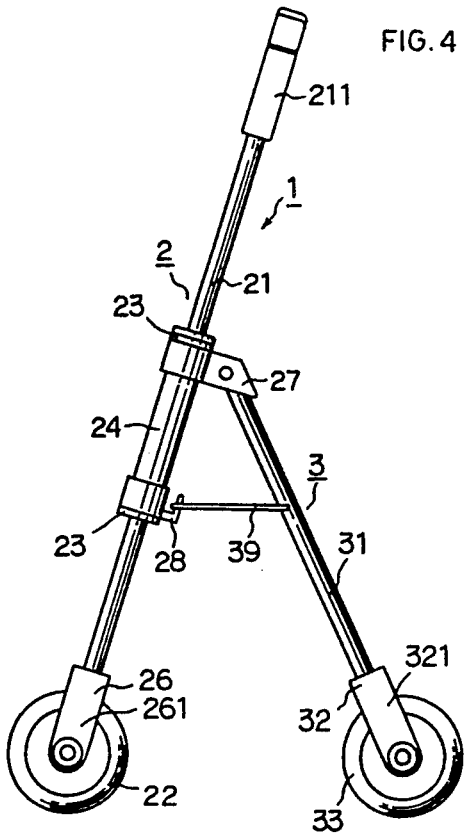
FIG. 4 is a side view of an embodiment of this invention in constructed state.

In FIG. 1 to FIG. 4, there is shown an embodiment of the walking stick 1 with wheels according to this invention.

The walking stick 1 with wheels comprises a main walking stick 2 having a wheel 2 which stick has a hollow support bar 21 and a forward wheel 22 rotatably mounted at the lower end thereof. An assistant walking stick 3 having a wheel, a hollow assistant bar 31, a back wheel 33 rotatably mounted on the lower end of said hollow assistant bar 31. A fastening bar member 39 and a hook 28 are provided for releasably connecting the main walking stick 2 and the assistant walking stick 3.

The main walking stick 2 comprises a hollow support bar 21 made of a pipe material in a certain length. A U-shape or L-shape handle part 211 mounted on the upper end of the support bar 21. A pair of the collars 23, 23 are fixed at a certain spacing on the upper portion and the lower portion of the center part of the hollow support bar 21. A connecting member 24 is formed like a short cylinder and it has a larger diameter than that of the hollow support bar 21. The connecting member 24 is rotatably supported between the pair of collars 23, 23. A support 26 comprising a pair of legs 261, 261 facing each other is made of metal or synthetic resin and it is mounted the lower end of the hollow support bar 21 whereby to support the forward wheel 22 rotatably at the lower end of the hollow support bar 21. The forward wheel 22 is round and has elasticity because it is made of synthetic resin or rubber material. The center of the wheel 22 is disposed rotatably between the legs 261, 261 of the bracket 26.

When user grips the handle part 211, and rests one's weight to cause the walking stick to move forwardly, the forward wheel 22 rotates and moves.

An assistant walking stick 3 is disposed between the spaced-apart legs 27 mounted on the upper part of the connecting member 24 of the main walking stick 2. The assistant walking stick 3 is pivotally disposed between the legs 27 to help the main walking stick 2 to open and shut freely.

The assistant walking stick 3 comprises a hollow assistant bar 31 disposed at the legs 27. The bar 31 is made of pipe material and is about one-half the length of the hollow support bar 21. The bracket 32 comprises a pair of boards 321, 321 facing each other are made of a material such as a metal or synthetic resin. The bracket 32 is mounted at the lower end of the hollow assistant bar 31. A back wheel 33 formed into a round shape and which has elasticity because it is made of synthetic resin or rubber material is disposed rotatably between the boards 321, 321 of the bracket 32.

The user grips the handle part 211, and rests his weight to move the walking stick forwardly. The forward wheel 22 rotates and moves. The back wheel 33 helps the forward wheel 22 to rotate. They help the user to walk in a stable state. The hook 28 is formed into an L-shape and made of such a material as metal or resin and is disposed at the lower part of the connecting member 24. The fastening bar member 39 is formed into a U-shape ( viewed from the top ) and is made of a material such as metal or resin, like the hook 28. The fastening bar member 39 is disposed at the center part of the assistant walking stick 3 and interconnects with the hook 28 to keep a certain distance between the main walking stick 2 and the assistant walking stick 3.

Figure 5:
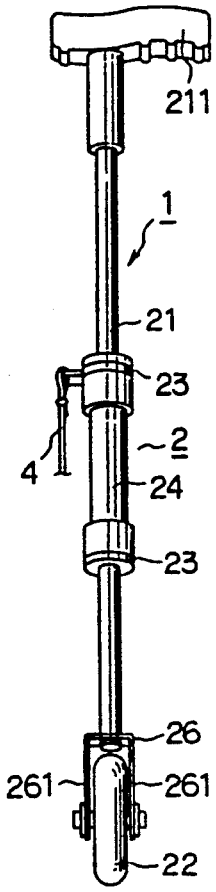
FIG. 5 is a front view of an embodiment of this invention.

Further, in the walking stick of FIG. 5, a string 4 is connected to the upper collar 23. The opposite end of the string 4 is connected to the waist of the user to prevent the walking stick 1 from separating from the user.

Embodiment 2

Figure 6:
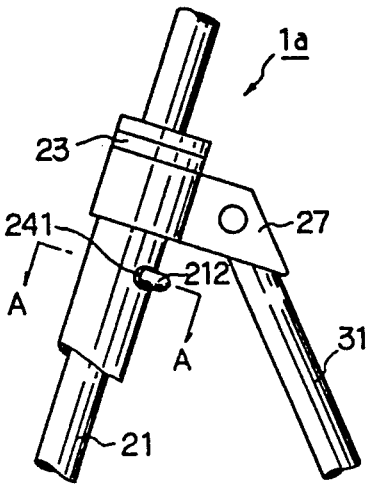
FIG. 6 is a partly enlarged view showing the relationship the hollow support bar and the connecting member.
Figure 7:
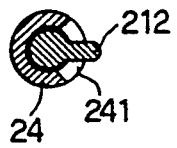
FIG. 7 is an A—A sectional view of FIG. 6.

FIGS. 6 and 7 show an embodiment of the walking stick with wheels la which has a structure to prevent the turn angle of the main walking stick 2 from extending beyond a certain angle, and improves the safety.

2 denotes the main walking stick with a wheel, 21 denotes the hollow support bar, 22 denotes the forward wheel, 28 denotes the hook, 3 denotes the assistant walking stick with a wheel, 31 denotes the hollow assistant bar, 33 denotes the back wheel, and 39 denotes the fastening bar member.

That is, the walking stick 1*a* in this embodiment comprises the projection 212 at the back of the center part of the connecting member 24 of the hollow support bar 21. An oblong hole 241 is formed by boring to the extent of from about 90 degrees to 120 degrees in the connecting member 24 corresponding the projection 212. When the handle part 211 of the main walking stick 2 moves right or left beyond a certain angle, the projection 212 hits on the edge of the oblong hole 241. Therefore the main walking stick 2 can't change the direction beyond a certain angle.

Embodiment 3

Figure 8:
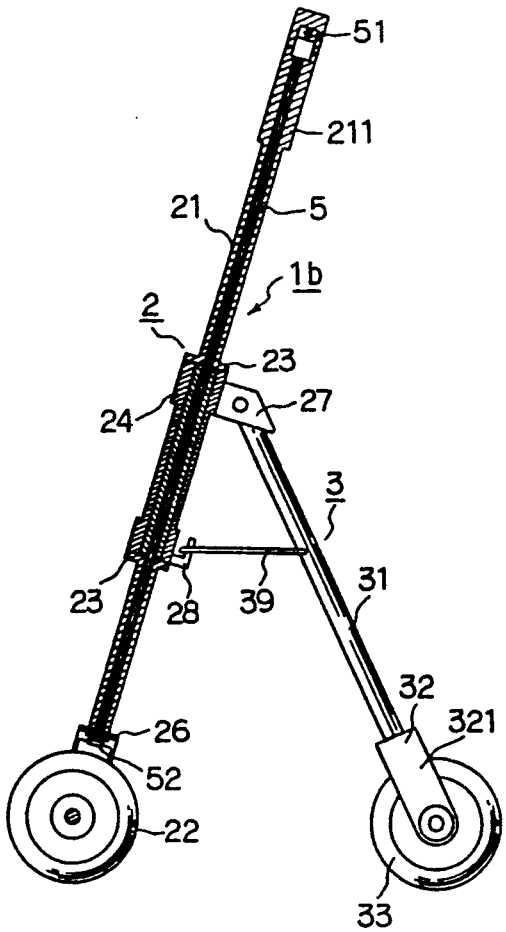
FIG. 8 is an explanatory view showing the inside of the hollow support bar.

FIG. 8 shows an embodiment of the walking stick with wheels 1*b* which is the same as the walking stick with wheels 1*a* shown above embodiment 2 in this invention but is provided with a brake structure.

2 denotes the main walking stick with a wheel, 21 denotes the hollow support bar, 22 denotes the forward wheel, 28 denotes the hook, 3 denotes the assistant walking stick with a wheel, 31 denotes the hollow assistant bar, 33 denotes the back wheel, and 39 denotes the fastening bar member.

The walking stick 1*b* in this invention provides the hollow support bar 21 of the main walking stick 2 as shown in FIG. 8.

The handle part 211 has an internal thin bar member 5 which is attached to the spring 51 at the upper end so as to urge the bar to return to the original position.

For example, a four-cornered elastic member 52 made of rubber or elastic resin is disposed at the lower end of the thin bar member 5.

The user grips the handle part 211 ( or pushes the handle part 211 downwardly ). The elastic member 52 can permit the forward wheel to move or it can stop the forward wheel 22.

If braking is needed, it is adjusted with the brake structure by the elastic member 52.

Figure 21:
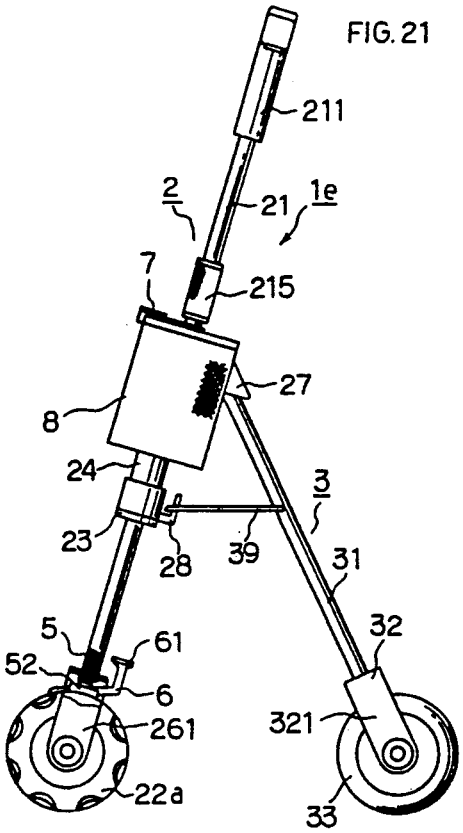
FIG. 21 is a explanatory view of the alternate embodiment.
Figure 22:
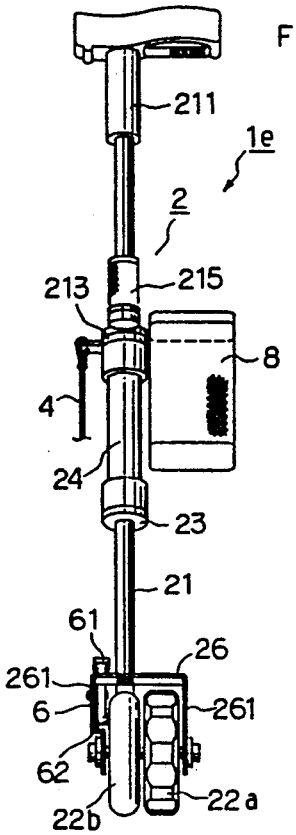
FIG. 22 is a front view of the alternate embodiment.

Further, in this embodiment, as shown FIG. 8, FIG. 21, and FIG. 22, by gripping ( or pushing ) the handle part 211, the elastic member 52 hits on the forward wheel 22. However, this means is optional.

Embodiment 4

FIG. 9 to FIG. 16 show an embodiment of the walking stick with wheels 1*c* which is constructed to fold or to expand and contract freely.

2 denotes the main walking stick with a wheel, 21 denotes the hollow support bar, 22 denotes the forward wheel, 24 denotes the connecting member, 28 denotes the hook, 3 denotes the assistant walking stick with a wheel, 31 denotes the hollow assistant bar, 33 denotes the back wheel, and 39 denotes the fastening bar member.

That is, as shown FIG. 9 to FIG. 12, the walking stick with wheels 1*c* in this invention has a folding part 213 at the upper part of the hollow support bar 21, and it enables the hollow support bar 21 to fold freely at the folding part 213.

A male screw part 214 is provided at the lower member of the folding part 213 of the hollow support bar 21. A small cylindrical stopping member 215 is provided to cover the folding part 213 and it has a female screw part on inner side which can engage the male screw part 213.

Figure 9:
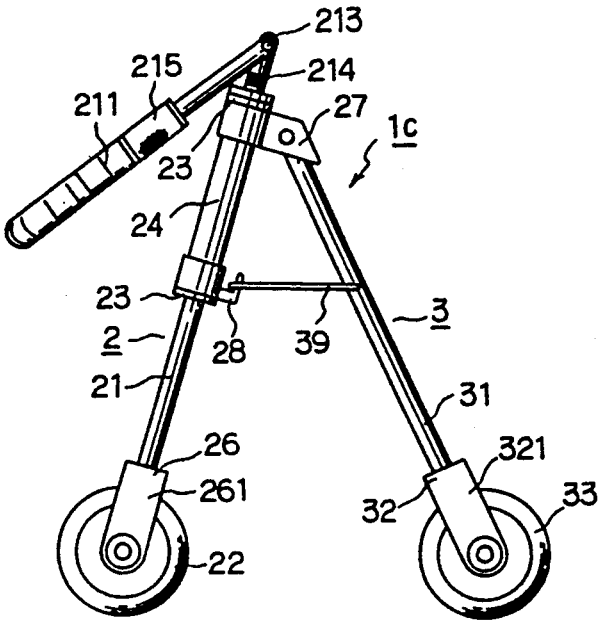
FIG. 9 is an explanatory view of alternate embodiment of this invention.
Figure 10:
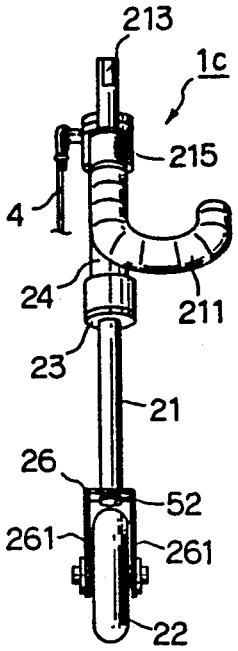
FIG. 10 is an explanatory view of alternate embodiment of this invention.

By folding the hollow support bar 21 at the folding part 213, it can be made short as shown FIG. 9 and FIG. 10.

Figure 11:
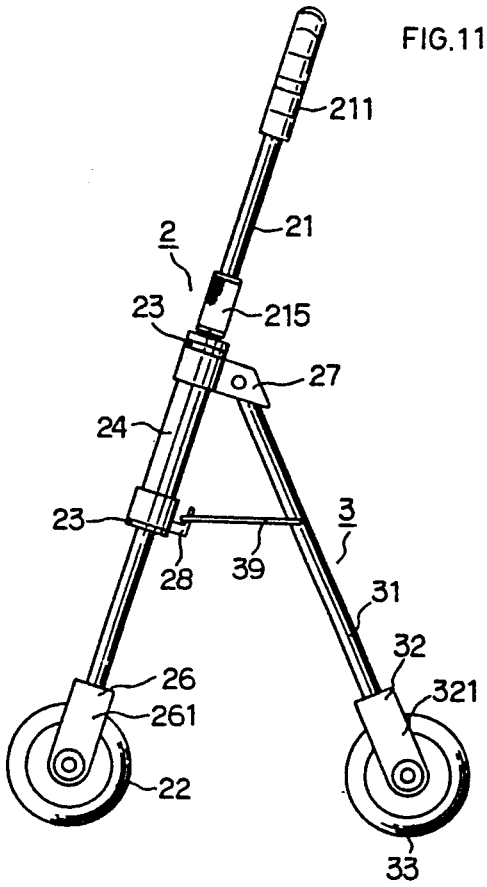
FIG. 11 is a side view of alternate embodiment of this invention.
Figure 12:
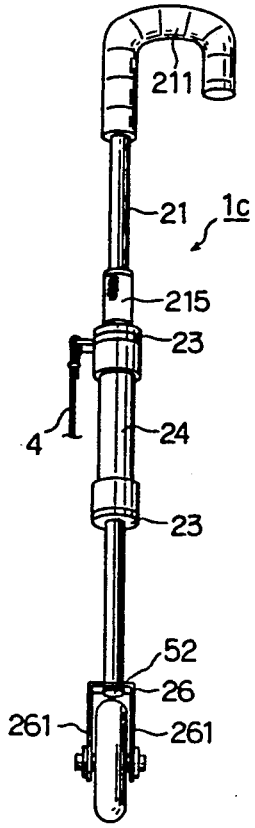
FIG. 12 is a front view of alternate embodiment of this invention.
Figure 13:
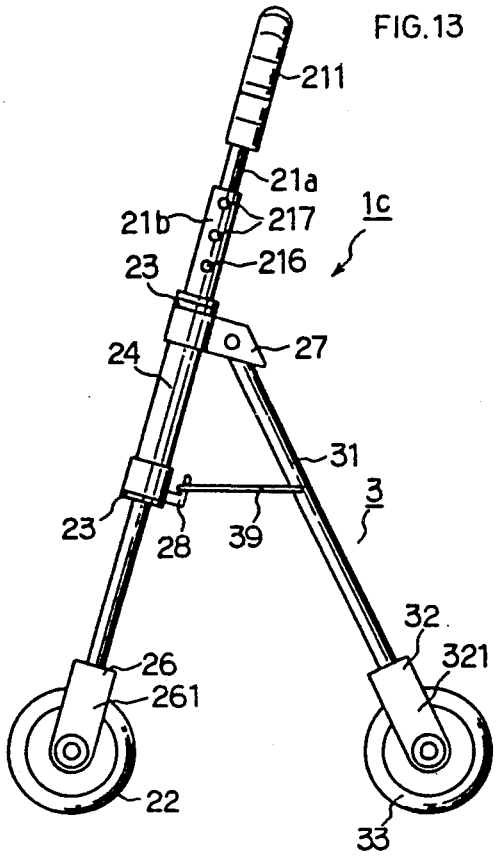
FIG. 13 is a side view of the contracted hollow support bar.
Figure 14:
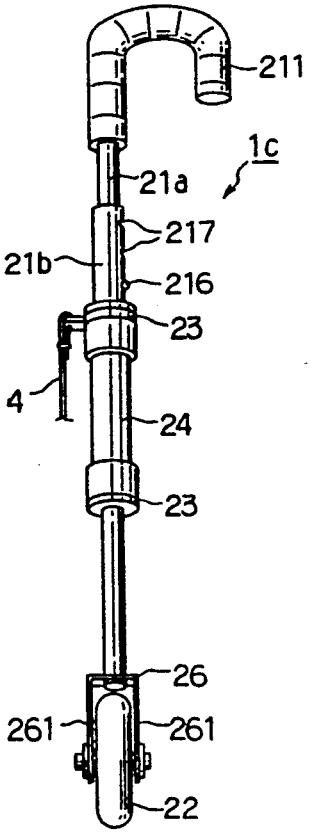
FIG. 14 is a front view of the contracted hollow support bar.
Figure 15:
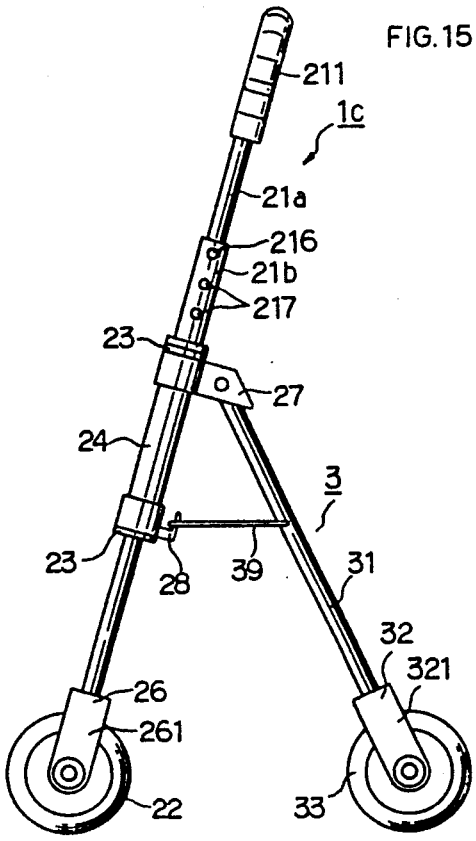
FIG. 15 is a front view of the expanded hollow support bar.
Figure 16:
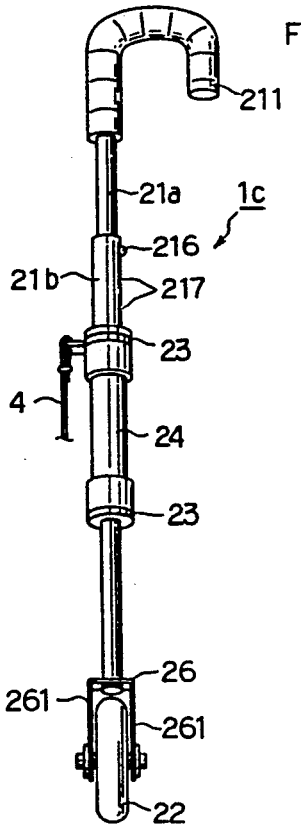
FIG. 16 is a front view of the expanded hollow support bar.

By making the folding part 213 of the hollow support bar 21 straight, and making the small cylindrical stopping member 215 engage with the screw part 214, it can expanded as shown FIG. 11 and FIG. 12.

When the walking stick 1*c* is provided with a brake structure as shown in FIG. 8, the folding part 213 is disposed at the upper part of the hollow support bar 21, and it enables the hollow support bar 21 to fold freely at the folding part 213.

With disposing the folding part ( not shown ) at the position corresponding the folding part 213, the thin bar member 5 which can fold with the folding part 213 and is attached to the spring at the end in the handle part 211 is put into the hollow support bar 21.

The elastic member 52 is disposed at the lower end of the thin bar member 5, and the male screw part 214 is made at the lower part of the folding part 213 of the hollow support bar 21.

The small cylindrical stopping member 215 can cover the folding part 213 which has the female screw part on the inner side which can engage with the male screw part 214.

Consequently, when the hollow support bar 21 is folded at the folding part 213, the thin bar member 5 is also folded to be small, and when making the folding part 213 of the hollow support bar 21 straight, the thin bar member 5 of inside is also expanded in the original state, and in the state, the male screw part 214 is covered with the small cylindrical stopping member 215.

They compose the walking stick with wheels 1*c* which can be adjusted by the brake structure.

FIG. 13 to FIG. 16 show a walking stick with wheels 1*c* in this invention which can expand and contract by other means.

In the walking stick with wheels 1*c*, the hollow support bar 21 is divided into two pieces, the upper part and the lower part, with the connecting member 24 as the border.

The upper end of the upper part has a U-shape or L-shape handle part 211, and the lower part of the handle part 211 comprises a short hollow support bar 21*a* provided with a projecting ball member 216 attached to springs and the cylindrical fitting member 21*b* which has the plurality of small holes 214 in line along the bar fitting the projecting ball member 216 to be put on the short hollow support bar 21*a*.

By changing the fitting position of the projecting ball member 216 of the short hollow support bar 21*a* and the small holes 217 of the cylindrical fitting member 21*b*, the walking stick with wheels can be expanded and contracted in extent as shown from FIG. 13 and FIG. 14 to FIG. 15 and FIG. 16.

Embodiment 5

Figure 17:
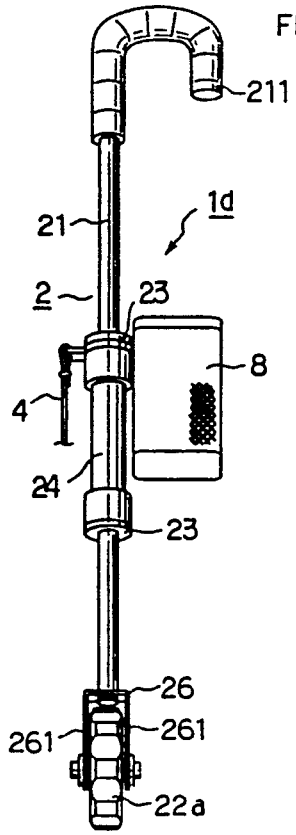
FIG. 17 is a front view of the embodiment attached the wave shape wheel in this invention.
Figure 18:
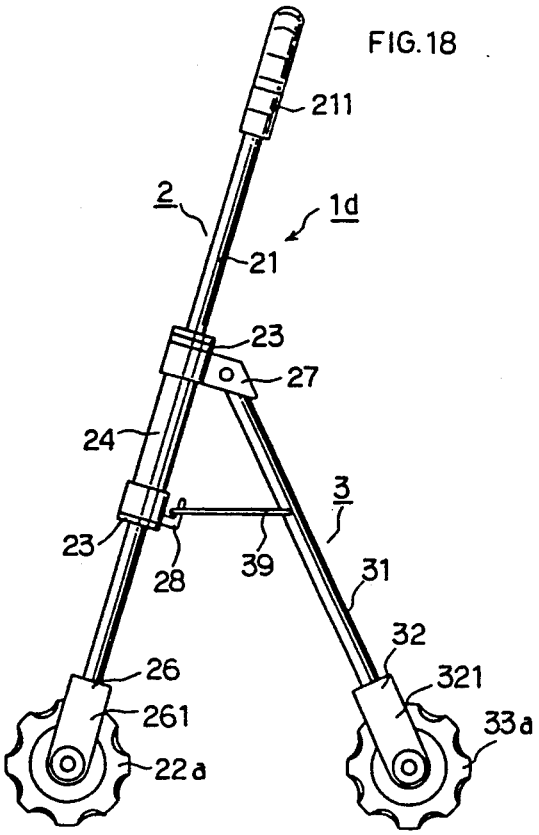
FIG. 18 is a side view of the embodiment attached the wave shape wheel in this invention.

FIG. 17 and FIG. 18 show an embodiment 1*d* of the walking stick with wheels in this invention which adapts to a road covered with gravel or the unpaved sidewalk.

2 denotes the main walking stick with a wheel, 21 denotes the hollow support bar, 24 denotes the connecting member, 28 denotes the hook, 3 denotes the assistant walking stick with a wheel, 31 denotes the hollow assistant bar, and 39 denotes the fastening bar member. That is, at least one of the forward wheel 22 rotatably disposed between the legs 261, 261 of the bracket 26 disposed at the lower end of the hollow support bar 21 and the back wheel 33 rotatably disposed between the boards 321, 321 of the bracket 32 disposed at the lower end of the hollow assistant bar 31 is changed to the wave shape wheel 22*a* or 33*a* which has a rugged part spaced at a certain interval on the periphery or a tooth-shaped wheel ( not shown ) and is disposed rotatably.

Consequently, it absorbs obstacles, such as gravel, on the road into the cavities, and removes the obstacle against the wheels and it prevent the user from stopping.

FIG. 21 and FIG. 22 are showing an embodiment 1*e* of the walking stick with wheels in this invention which adapts to a road covered with gravel or the unpaved sidewalk and can remove unpleasant feeling such as the shock in adapting to the paved sidewalk.

The wave shape wheel 22*a* which has rugged part spaced at a certain interval on the periphery or the tooth-shaped wheel ( not shown ) is disposed coaxially with the forward wheel 22 rotatably disposed between the legs 261, 261 of the bracket 26 disposed at the lower end of the hollow support bar 21, and they are disposed rotatably.

Consequently, it absorbs the obstacles, such as gravel, on the road into the cavities of the wave shape wheel 22*a*, and removes the obstacle against the wheels and it prevents the user from stopping.

In walking on a paved road, the user rests his weight on the forward wheel 22 and it removes the unpleasant feeling such as the shock.

Further, 8 denotes the basket which can be installed at the optional position of the hollow support bar 21.

It is needless to say that the fastening hook can be installed instead of the basket 8.

Embodiment 6

Figure 19:
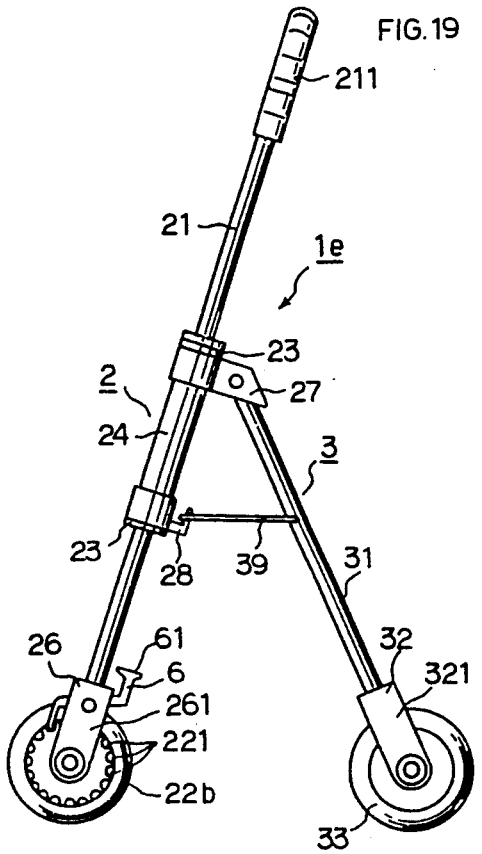
FIG. 19 is a side view of the embodiment attached the locking structure.

FIG. 19 shows an embodiment of the walking stick with wheels le which can stop temporarily in a safe state in walking with the walking stick 1 in this invention.

2 denotes the main walking stick with a wheel, 21 denotes the hollow support bar, 24 denotes the connecting member, 28 denotes the hook, 3 denotes the assistant walking stick with a wheel, 31 denotes the hollow assistant bar, and 39 denotes the fastening bar member.

That is, the forward wheel 22 disposed rotatably between the legs 261, 261 of the bracket 26 at the lower end of the hollow support bar 21 is formed into a forward wheel 22*b* disposed the plurality of stopping small cavities 221 on the whole of both sides.

The locking member 6 is formed into about an S-shape made of rigid material such a metal, in the space between the forward wheel 22*b* and the bracket 26 and disposes the stopping pin 62 ( cf. FIG. 22 ) made of the same material which can fit with the stopping small cavities 221 at the end.

And the locking member 6 disposes the spring ( not shown ) between a pair of legs 261, 261.

When the user stops temporarily or stops for a long time, the user steps on the pedal part 61 of the locking member 6, the stopping pin 62 of the locking member 6 gets in the adjacent stopping small hole 221 by the power of the spring, and it can stops the forward wheel 22*b* at once.

Figure 20:
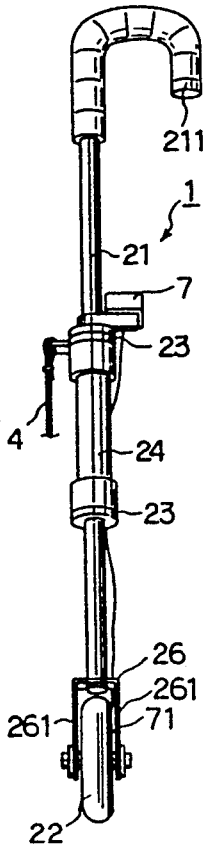
FIG. 20 is a front view of the embodiment attached the distance meter.

Further, FIG. 20 shows an embodiment which installs a distance meter 7 generally used in a walking stick with wheels 1 in this invention.

By installing the rotating disk 71 which can run the distance meter 7 on the forward wheel 22 closely, the distance of walking is measured easily.

The embodiments of the invention in which an exclusive property or priviledge is claimed are defined as follows:

1. A walking stick with wheels comprising a hollow support bar which has a U-shaped or L-shape handle part at an upper end thereof, a connecting member rotatably mounted on a central part of the support bar between collars fixed at upper and lower ends of the central part, a first bracket joined at a lower end of said hollow support bar, said first bracket having a pair of spaced legs, a forward wheel rotatably installed between said legs, a hollow assistant bar having an upper end pivotally connected to an upper part of said connecting member, said assistant bar being about half the length of said hollow support bar, a second bracket having a pair of spaced legs, said second bracket being mounted on a lower end of the hollow assistant bar, a back wheel rotatably installed between the legs of said second bracket, a fastening bar disposed at the center of the assistant bar with a wheel and a hook disposed at a lower part of the connecting member for releasable connection with said fastening bar.

2. The walking stick of claim 1 having a projection at the back of the center part of the hollow support bar, said connecting member having a circumferentially elongated hole through which said projection extends.

3. The walking stick of claim 2 in which a thin bar member is disposed with a spring in the handle part of the hollow support bar and an elastic member is disposed at a lower end of the thin bar member to move said elastic member toward or away from said forward wheel forward or backward.

4. The walking stick of claim 2 in which the upper part of the hollow support bar is provided with a folding part, a male screw part is provided at the lower part of said folding part, and a small cylindrical stopping member which can engage with said male screw part and can cover the folding part is placed on said folding part to fold freely.

5. The walking stick of claim 4 in which a thin bar member which is attached to a spring at the upper end in said handle part and can fold at the folding part of the hollow support bar is received in said hollow support bar, and an elastic member is disposed at the lower end of said thin bar member, when the hollow support bar extends straight, said elastic member can engage said forward wheel.

6. The walking stick of claim 2 in which said hollow support bar is divided into two pieces with said connecting member being located at the juncture of said two pieces, the upper piece has a U-shape or L-shape handle and comprises a short support bar, a projecting ball member attached to a spring at the lower side and a cylindrical fitting member inserted in said hollow support bar, a plurality of small holes being adapted to receive the projecting ball member to expand and contract the bar.

7. The walking stick of claim 1 in which at least one of said forward wheel and said back wheel is formed into the wheel which has wave-shaped or tooth-shaped rugged part spaced at a certain interval on the periphery thereof.

8. The walking stick of claim 7 in which at least one wheel which has a wave-shaped or a tooth-shaped rugged part therearound is disposed coaxially with the forward wheel.

9. The walking stick of claim 1 in which a plurality of stopping small holes are provided on the sides of said forward wheel and an S-shape locking member is disposed in the space between said forward wheel and said legs of said first bracket.

10. A wheeled, walking stick, comprising:

an elongated, hollow, support bar structure having an upper end, a lower end and a central region having longitudinally spaced collars;

a handle mounted on the upper end of said support bar structure;

a first mounting bracket mounted on the lower end of said support bar structure, said first mounting bracket having a first pair of spaced-apart, downwardly extending legs;

a main wheel rotatably mounted on said first bracket between said first pair of legs and adapted for rolling along the ground;

a connecting member rotatably supported on the central region of said support bar and supported at its upper and lower ends by said collars, said connecting member having an attaching structure projecting rearwardly therefrom close to the upper end thereof, said connecting member also having a hook projecting rearwardly therefrom close to the lower end thereof;

an elongated, hollow, auxiliary bar structure having an upper end, a lower end and a central region between said ends, the length of said auxiliary bar structure being approximately one-half the length of said support bar structure, the upper end of said auxiliary bar structure being pivotally connected to said attaching structure;

a second mounting bracket mounted on the lower end of said auxiliary bar structure, said second mounting bracket having a second pair of spaced-apart downwardly extending legs;

an auxiliary wheel rotatably mounted on said second bracket between said second pair of legs and adapted for rolling along the ground;

a fastening bar pivotally mounted on said auxiliary bar structure in the central region thereof, said fastening bar being engageable with said hook to releasably maintain said auxiliary bar structure in a downwardly diverging state relative to said support bar structure;

a thin bar member disposed within said support bar structure;

a spring disposed in said handle; and an elastic member attached to the lower end of said bar member so as to be movable toward and away from said main wheel and to brake rotation of said main wheel.

11. A walking stick as claimed in claim 10 in which said support bar structure has a rearwardly extending projection, said connecting member has a circumferentially elongated slot in the rear side thereof, said projection projecting outwardly through said slot to limit rotation of said support bar structure relative to said connecting member.

* * * * *